US008627612B2

(12) United States Patent
Wilsey

(10) Patent No.: US 8,627,612 B2
(45) Date of Patent: Jan. 14, 2014

(54) BUILDING STRUCTURE AND METHOD

(76) Inventor: Mark E. Wilsey, Pagosa Springs, CO (US)

( * ) Notice: Subject to any disclaimer, the term of this patent is extended or adjusted under 35 U.S.C. 154(b) by 0 days.

(21) Appl. No.: 13/337,885

(22) Filed: Dec. 27, 2011

(65) Prior Publication Data

US 2012/0102875 A1 May 3, 2012

Related U.S. Application Data

(63) Continuation of application No. 11/309,015, filed on Jun. 8, 2006, now Pat. No. 8,104,233.

(60) Provisional application No. 60/595,139, filed on Jun. 8, 2005.

(51) Int. Cl.

| | |
|---|---|
| ***E04H 1/00*** | (2006.01) |
| ***E04B 5/00*** | (2006.01) |
| ***E04F 13/04*** | (2006.01) |
| ***E04B 1/00*** | (2006.01) |
| ***E04B 1/62*** | (2006.01) |
| ***E04C 2/54*** | (2006.01) |

(52) U.S. Cl.
USPC ..... 52/79.1; 52/411; 52/449; 52/452; 52/516; 52/745.05; 52/745.06; 52/783.1; 52/783.14; 52/783.15; 52/783.17; 52/783.19

(58) Field of Classification Search
USPC ..... 52/63, 411, 449, 452, 515–517, 606, 52/745.05, 745.06, 783.1, 783.14–783.19
See application file for complete search history.

(56) References Cited

U.S. PATENT DOCUMENTS

| | | | | |
|---|---|---|---|---|
| 3,277,219 | A * | 10/1966 | Turner | 264/45.2 |
| 3,506,746 | A * | 4/1970 | Fontaine | 264/32 |
| 3,572,002 | A | 3/1971 | Nichols | |
| 3,619,432 | A | 11/1971 | Harrington | |
| 3,932,969 | A * | 1/1976 | Matras | 52/86 |
| 4,064,663 | A | 12/1977 | Moss | |
| 4,077,177 | A * | 3/1978 | Boothroyd et al. | 52/745.07 |
| 4,159,361 | A * | 6/1979 | Schupack | 442/63 |
| 4,253,288 | A | 3/1981 | Chun | |
| 4,265,961 | A | 5/1981 | Bena | |
| 4,279,680 | A * | 7/1981 | Watson, Jr. | 156/212 |
| 4,287,241 | A | 9/1981 | Kaufmann | |
| 4,488,392 | A * | 12/1984 | Pearcey et al. | 52/741.11 |
| 4,581,860 | A | 4/1986 | Berger | |
| 4,617,219 | A | 10/1986 | Schupack | |
| 5,094,044 | A * | 3/1992 | Dykmans | 52/80.1 |
| 5,230,844 | A | 7/1993 | Macaire et al. | |
| 5,566,521 | A | 10/1996 | Andrews et al. | |
| 5,771,649 | A | 6/1998 | Zweig | |
| 5,803,964 | A | 9/1998 | Scarborough | |
| 6,108,993 | A | 8/2000 | Hageman | |
| 6,490,834 | B1 | 12/2002 | Dagher | |
| 6,960,394 | B2 | 11/2005 | Graham et al. | |
| 7,166,365 | B2 | 1/2007 | Bramlett et al. | |

* cited by examiner

*Primary Examiner* — Phi A
*Assistant Examiner* — Omar Hijaz
(74) *Attorney, Agent, or Firm* — The Marbury Law Group, PLLC

(57) ABSTRACT

A net layer (32) defines the shell (40) of a building, carried by any necessary supports. A hardening layer (34) is applied to fix the shape of the net layer (32) and to establish wall, roof, and floor. Optionally the shell is of sufficient strength to receive application of further layers in order to define an exoskeleton. Structures of roof sections include parallel-sided segments and converging-sided segments, with troughed or domed section shapes. Structures of walls include opposed shell sides (35), (78) and central filler layers (70), together defining an exoskeleton. Posts (72) can add additional structural capacities for supporting walls, roof and floor and can be formed integrally of net (32) and hardener (34).

15 Claims, 18 Drawing Sheets

BUILDING STRUCTURE AND METHOD

CROSS-REFERENCE TO RELATED APPLICATIONS

This application is a Continuation of U.S. patent application Ser. No. 11/309,015, filed Jun. 8, 2006, which claims the benefit of U.S. Provisional Application No. 60/595,139, filed Jun. 8, 2005, both of which are incorporated herein by reference in their entirety.

BACKGROUND OF THE INVENTION

1. Field of the Invention

The invention generally relates to static structures such as buildings. More specifically, the invention relates to open work and to a building structure in which an in situ mold supports an applied surface material.

2. Description of Related Art Including Information Disclosed Under 37 CFR 1.97 and 1.98

Construction methods for conventional housing and commercial buildings often employ wood framed walls covered by external sheathing and an outer finish layer of masonry, stucco, wood siding, shingles, or the like. These methods and structures are costly and time-consuming.

High and rising construction costs contribute to economic inflation. High and increasing rents contribute to a reduced standard of living for many people. High construction prices exclude many people from home ownership. High rents for office space contribute to the failure of small business.

U.S. Pat. No. 5,566,521 provides a strong and durable structure and method for constructing buildings. However, still more rapid building systems are desirable.

It would be desirable to produce buildings of all descriptions by new methods that enable rapid erection at lower cost than conventional methods.

Further, it would be desirable to fabricate building structures in situ, using locally available materials that may be wastes or recycled materials of potentially very low cost.

In addition, it would be desirable to have available a method of building structures that is changeable on site, by merely altering the shape or placement of a fabric that is minimally supported.

To achieve the foregoing and other objects and in accordance with the purpose of the present invention, as embodied and broadly described herein, the method and structure of this invention may comprise the following.

BRIEF SUMMARY OF THE INVENTION

Against the described background, it is therefore a general object of the invention to provide a building structure and method for constructing a building in a substantially shorter time than typical by prior, conventional methods, using low cost, readily available materials, especially indigenous materials.

A closely related object is to provide a structure and method of construction that replaces traditional or conventional internal post and beam structural configuration with a more economically attractive alternative. In particular, the alternative construction provides an exoskeleton or external structural element. Exoskeleton construction is the most efficient type of construction. The alternative construction may include a post and beam, an exoskeleton skin without post and beam, or both.

An optional related object is to enable the use of indigenous materials when and where practical, both for convenience and cost savings.

Another object is to provide a method of constructing a building that allows one of three structural parts of an exoskeleton to be fabricated on-site and first utilized as a mold, second utilized as one of two structural skins, and third utilized as a finished coating.

According to the invention, a building shell or envelope is formed of a net layer that is carried by any necessary supports. A hardening layer is applied to fix the shape of the net layer and to establish wall, roof, and floor sections, which if desired are formulated to be of sufficient strength to be a finished assembly. If required, especially to accommodate changes of plan, the hardened net may serve as an in situ mold for receiving application of further layers. Building sections can be generally flat or can be arranged in shapes selected from parallel-sided segments and converging-sided segments, with troughed or domed section shapes, and combinations of these. A building structure can be formed of shell sides and central spacer or filler layer. Optionally, posts or beams support the walls, roof, and floor sections and can be formed integrally of net and hardener layers.

The structure of the building shell provides a first self-supporting component layer that is structurally adapted to bear both tensile and compressive loading. The first layer is formed of fabric treated with fixable material. A second self-supporting component layer is spaced from said first component layer by an intermediate layer. The second layer is structurally adapted to bear both tensile and compressive loading and is formed of a tensile element treated with fixable material. The intermediate component layer occupies the space between the first and second component layers and establishes an exoskeleton structure.

The tensile element of the second layer can be a structural post. The fixable material covers the structural post, integrating the post into the second component layer.

Alternatively, the tensile element of the second layer can be a layer of fabric. In this variation, the second component layer also may include a structural post that is covered or wrapped by the layer or fabric. Both the post and fabric are treated with the fixable material to establish an integrated structure.

Similarly, the first component layer may include a first structural post that is covered by the fixable material; and the second component layer may include a second structural post that is fixed in the second component layer by a covering layer of fabric treated with the fixable material. The first and second structural posts can be arranged in either offset alternating positions or in opposite juxtaposed positions.

In another variation, the first component layer includes a first structural post that is fixed in the first component layer by a covering layer of the fabric treated with fixable material. The second component layer is attached to the first structural post at a side opposite from the first component layer, such that the first structural post establishes the thickness of the space between the first and second component layers.

According to a method of forming a building structure, first a framework or support is erected, suited for carrying a layer of fabric in the general shape of the intended building or any of its components. Next, the layer of fabric is applied over the framework to define the building or a building component. Then, the fabric layer is treated with a fixable material that combines with the fabric to form a self-supporting shell structure of the building or building component. The shell is self-supporting exclusive of the framework, which then becomes an optional structure. Thus, optionally the framework is removed after the self-supporting shell has been established.

Removing the framework allows the reuse of its components and is especially useful where the framework components are in short supply or the components are a nonrenewable or scarce resource.

The fixable material is a hardener or coating that at least partially penetrates into the fabric layer before or as it hardens, forming a first self-supporting shell. The fabric and fixable material form a hard shell that is sufficiently self-supporting that subsequently it can serve as a mold for application of further layers. Thus, it is possible to apply a second layer of fabric over the first self-supporting shell. The second fabric layer then can be treated with a fixable material to establish a second layer of shell. Multiple layers of shell may be formed in series to achieve a desired strength. Also, the ability to form multiple layers without employing a mold other than the next underlying shell layer allows the strength of a building or of any selected building component to be increased or adjusted in the field. This field adjustment requires no waiting for availability and delivery of additional structural components such as larger trusses, as would be required in conventional building practice.

The building method contemplates that an exoskeleton structure will be desirable for most building structures. In order to achieve an exoskeleton structure, an intermediate spacer layer is applied on the first self-supporting shell. Then a second layer of fabric is applied over the intermediate layer. The second fabric layer is treated with fixable material to establish a second layer of shell structure over the intermediate layer, thereby creating in situ the exoskeleton structure. Thus, the ability to mold one layer upon another allows the efficient formation of an exoskeleton having opposite structural skins separated by an intermediate layer of selected and variable thickness.

Recognizing that a fabric or net layer might be difficult to work with in high winds or due to other ambient difficulties, it is possible to overcome such a problem by pretreating the fabric to stiffen it. After the fabric has been applied to a framework or mold surface, it may be treated by applying a thin, fast acting surface coat of hardening agent or penetrating agent that stiffens fibers of the fabric layer.

In certain structures and building types, it may be desirable to modify the characteristics of an exoskeleton or shell by the addition of structural members such as posts or beams. This modification can be implemented by forming the first self-supporting shell and then applying structural supporting members to the shell. In a specific application of this concept, a roof section can be fabricated by erecting a framework of at least two upper roof supports in an at least partially spaced apart orientation. The fabric layer is applied to this framework and treated with fixing agent. If the fabric layer is applied in tension between the supports, the result is a flat roof section. If the fabric layer is applied in loose or draped configuration between the supports, the result is a troughed or catenary curved roof section. The step of applying the fixing layer to the fabric both hardens the fabric into a shell and incorporates the roof supports into the shell.

In a variation of the method, the upper roof supports are supported at a preselected level, and the troughed portion of the draped fabric extends below the preselected level. Then, before fixing agent is applied, a lower roof support is applied to the troughed portion of the fabric below the preselected level. The lower roof support tensions the fabric between upper and lower roof supports, establishing a shell having a folded plate structure. Both upper and lower supports are incorporated into the shell.

In another variation of roof structure, a fabric layer is draped between roof supports in troughed configuration. Treating the fabric with fixable material establishes a self-supporting, troughed roof shell structure. The troughed roof shell structure is inverted to form a vaulted roof structure.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is a building structure and a method for constructing a structurally sound building potentially in a reduced time and potentially at a reduced cost as compared to prior conventional practices. The building structure is constructed as an exoskeleton. For purposes of defining such a building structure, an exoskeleton employs three features: an inner structural skin or shell, an outer structural skin or shell, and an intermediate filler layer having the function of spacing apart the inner and outer shells in order to increase depth of member or moment of inertia. The invention refers to a building structure, which encompasses all parts of a building, such as roof, floor, walls, and finish coatings. Components such as wall or roof will be described individually in order to disclose preferred structure, but the teachings of any component are applicable to all other components and entire building structures. The method and resulting structure are best understood by reference to the drawings.

Figure 1:
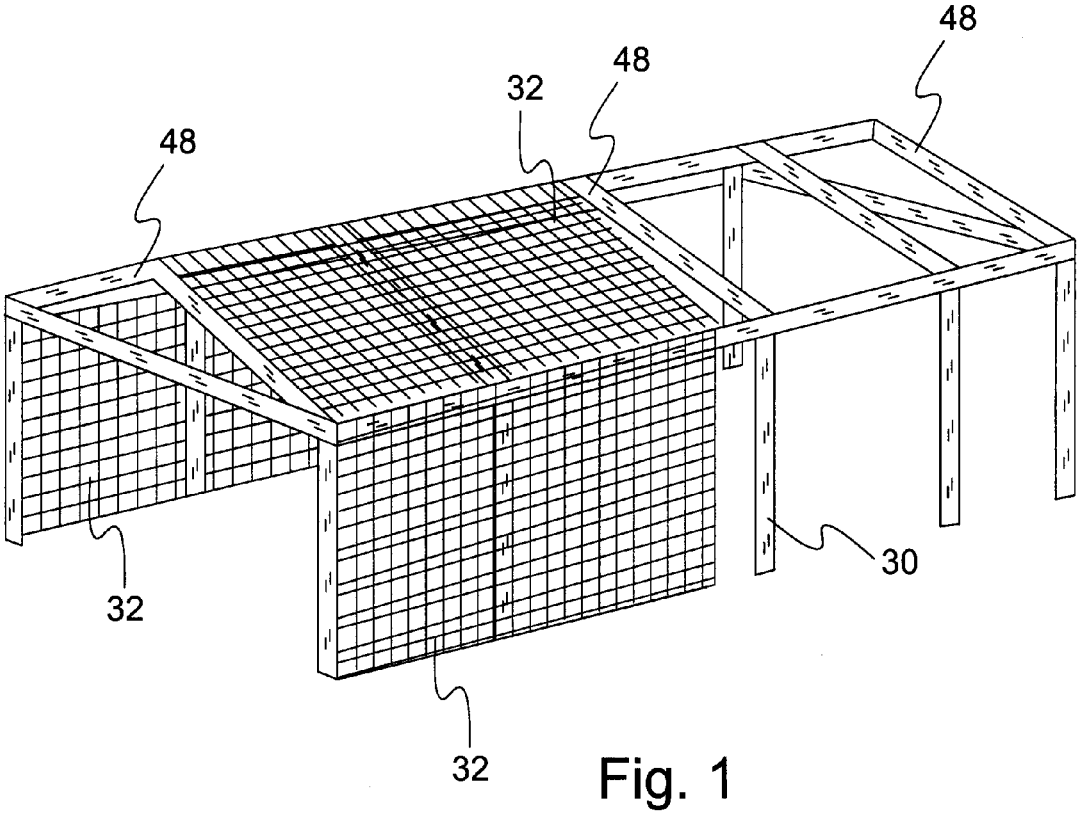
FIG. 1 is an isometric view of a building at a preliminary stage of construction.

In FIG. 1, a temporary, re-usable, framework 30 defines or holds the shape of a draped layer of net, scrim, or fabric 32. The quantity of wood needed for a residential structure is expected to be less than one-hundredth of the amount used for conventional construction. For convenience of description and not as a limitation, layer 32 interchangeably will be termed a "net" or "fabric." In a main or principal treatment, the net is treated or coated with a substantial layer of material that itself assumes a fixed or permanent shape or, preferably, in combination with the net causes the net and coating as a combined entity to assume a fixed or permanent shape. The fabric 32 and principal coating form a structural shell of the building or building component. The treated net may be described as being hardened or frozen in a permanent shape.

In this context, "frozen" refers to establishment of a permanent or fixed shape and does not necessarily require or imply the use of cold temperatures. The treating or coating will be referred to as a fixable material or fixing agent, which indicates that the material itself or the material in combination with the net layer in due course forms a structure that is self-supporting, for example by the fixable agent hardening or drying. This definition accommodates a possible cure time, drying time, or the like, if any, in order for the fixed or permanent shape to be achieved.

For purposes of this invention, preferred netting materials include rock fibers, particularly basalt fibers, to form structural nets or scrims. These preferred choices perform particularly well as compared to known construction netting, scrim, cloths, and lathe. However, known scrims of various other materials can be used. Known materials include plastics, polymers, other synthetics, fiberglass, metals, and alloys. Polymers can have a reinforced core or may be of the type referred to as fiber reinforced polymers. Examples of fibers added to a polymer are glass, carbon, polypropylene, and like materials. Examples of synthetics include high-density polyethylene, low-density polyethylene, nylon, polypropylene, and like materials. Examples of metals and alloys of metals include steel and aluminum.

The use of basalt fiber in netting and in other elements of the building structure produces improved performance and environmental advantage. This type of fiber is produced from a substantially unlimited resource, as basalt or similar rock that composes roughly 90% of the earth's crust. Basalt fibers previously have lacked sufficient grip to function properly in concrete mix designs or as a scrim for receiving a concrete coating. As used here, the term 'grip' refers to the ability of a deformed reinforcing bar to resist any movement or slippage when encased with concrete.

Figure 19:
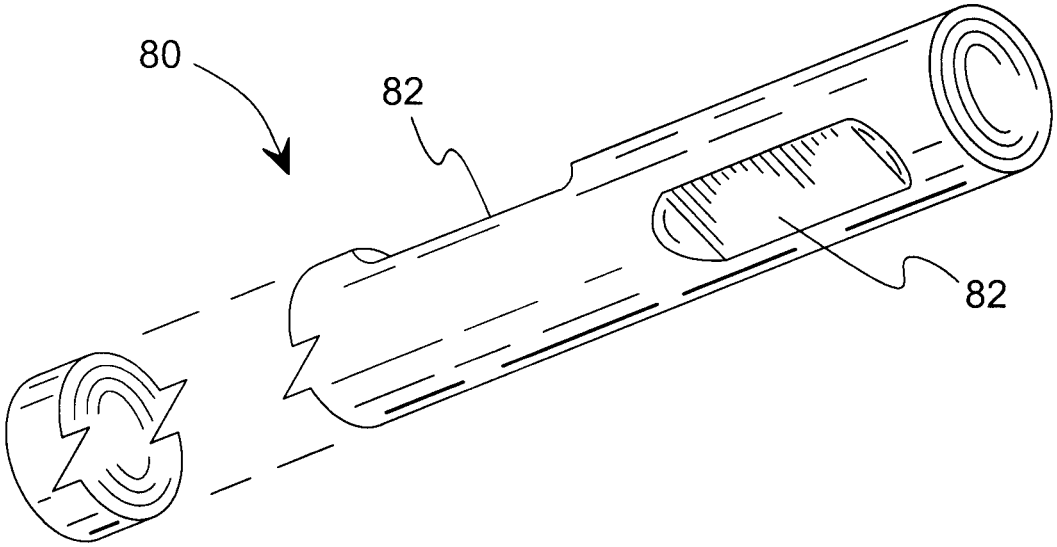
FIG. 19 is an isometric view of a basalt filament structure, showing deformations increasing grip.

Basalt filaments or fibers are produced by heating basalt to a melting or plastic temperature, and the molten material is then extruded through bushings. In further processing at a forehearth, the filaments are next combined or woven into the final product and sized, typically by addition of a plastic or polymer coating. Final products might be a strand useful in forming netting or fabric, or strands can be combined to form a reinforcing bar similar to steel rebar. FIG. 19 shows an elongated element 80 that might be a fabric strand, reinforcing bar, or other product formed of basalt fibers or filaments.

In order to create a fiber with improved grip, the basalt material can be deformed while being processed from hard rock, to molten rock, to malleable rock, and back to cooled hard filament. The deformations 82, FIG. 19, can be surface deformations similar to the surface ribs utilized on steel reinforcing bar. However, in a preferred processing step for maintaining an optimum ratio of strength to material quantity, the deformations 82 should not be configured out of additional material, such as the ribs added to typical steel reinforcing bar. Thus, in a preferred embodiment the deformations 82 are flattened segments of the basalt filament. This method of increasing grip allows the basalt filaments 80 to remain in a parallel configuration, which is the preferred alignment for the filaments to bear tensile loads.

Alternate method of increasing grip may be utilized. Filaments can be deformed, such as by kinking, bending, or forming into loops. Deformed filaments are suitable for use in rebar, in scrim or net, or as chopped fiber. The addition of a sizing or coating may sufficiently increase grip characteristics as necessary to meet structural testing standards.

Used as netting, rebar, or chopped fiber, the improved basalt fibers or filaments are significantly stronger than other commonly used reinforcements. Basalt fibers are almost ten times stronger than grade forty steel reinforcement. Compared to the cost of producing steel rebar, production savings are almost thirty percent. Compared to the cost of producing carbon fiber, basalt fiber costs about one tenth as much; with the added benefit that basalt fiber yields ninety percent of the strength per pound of carbon fiber technology. Thus, strength, production economies, reduction of fossil fuel consumption for production and transportation, all provide improved characteristics of this material whether as a core fiber, such as in fiber reinforced polymers, or standing alone as a reinforcing element.

Known scrims of polymer and plastic are flexible in varying degrees. Flexibility has been acceptable for typical usage such as structural reinforcement. Various known applications for reinforcement are stucco, plaster, structural concrete, earth for erosion control, and structural stabilization under roads. Thus, known netting is useful as a means of holding or maintaining material in some specific kind of discipline. Most are sold and transported in rolls exhibiting this characteristic. As well, most steel and aluminum scrims and stucco netting are in rolls, although some types of metal lath are supplied in flat pieces or sheets. However, even these sheets are flexible in one direction and may be flexible in both directions. These net materials have not been required to be frozen into static, hard, inflexible shape.

As an optional pretreatment before applying a principal coating or hardening layer, it may be desirable to substantially eliminate the flexibility of a net or fabric that has been placed in end position. Such a pretreatment applies a thin coating to the strands or fibers of the fabric. A net that is pretreated in end position has many notable advantages. First, the frozen net keeps material in discipline regardless of weather, such as wind, rain, snow, and the like. Second, the frozen net retains a fixed shape while a subsequent structural coating is applied. Third, the frozen net provides an initial strength, which may be compressive, tensile, or torsional. Fourth, the frozen net eliminates sagging or stretching of material. Fifth, the frozen net increases the grip or adhesion characteristic of the subsequently applied structural coating that may constitute a compressive element, while the net is a tensile element. Alternately, both net and applied coating may add compressive and tensile values. Sixth, the frozen net saves time and energy, contributing both a financial and environmental benefit.

The ability to freeze or harden some known net materials by pretreatment is specific to the chemistry of the material being utilized for the net. For some known net materials, the application of a hardener is well known. However, known processes for hardening net material require that any plastic, polymer, or synthetic coating on the net be thin enough to allow the hardener to penetrate into the coating. To overcome this limitation, this invention employs a pretreatment hardener that includes a solvent base or other chemical for temporarily softening the coating, which then allows the pretreatment hardener to penetrate the net material. The softening process is short. The thinness of the pretreatment coating allows the solvent or softener to evaporate quickly or to otherwise become ineffective after accomplishing the hardening and stiffening process. An alternative pretreatment may be performed in two steps, first by applying the solvent or softener, and second by following with a hardener that can penetrate or be absorbed by the softened fabric fibers.

Another approach to pretreatment is to harden, stiffen, or immobilize the fabric strands by coating them with an overcoat that, on a micro-scale, forms an exoskeleton by encasing the individual net strands. A suitable overcoating material must have high modulus and high tensile strength characteristics. Optionally, such material may have a fast or near instant set time in order to eliminate delay due to curing times or delay due to windy conditions. The overcoating material should be non-brittle when set. Examples of overcoatings that fulfill these requirements are urethanes such as polyurethanes, poly-ureas, acrylics, epoxies, and such polymer-based materials as will provide a level of efficacy for these characterized functions. In addition, cementitious base materials are desirable and may include materials that set by either hydration or polycondensation.

Pretreating by an overcoating material may be preferred over a hardening material due to several efficiencies. First, overcoating materials can be much less costly than various proprietary chemicals for hardening plastic nets. Second, applying an overcoating material can take less time, especially where a solvent must be applied prior to applying a hardening agent. Third, an overcoating agent typically can be applied in a single step, where hardening agents may require two or more application steps. Fourth, since an overcoat is on the outside of the existing net material surface, the overcoating material utilizes a greater depth of beam on micro scale and produces better strength efficiency. Fifth, the use of overcoating material may allow greater economy in selection of the net material. The overcoat or exoskeleton is analogous to the upper and lower chord of an engineered floor joist or roof rafter. In this arrangement, the net becomes structurally more efficient. A net of lower structural capacity may be used because of the compensating placement of the overcoat at a greater distance from the center of the net fiber.

Figure 2:
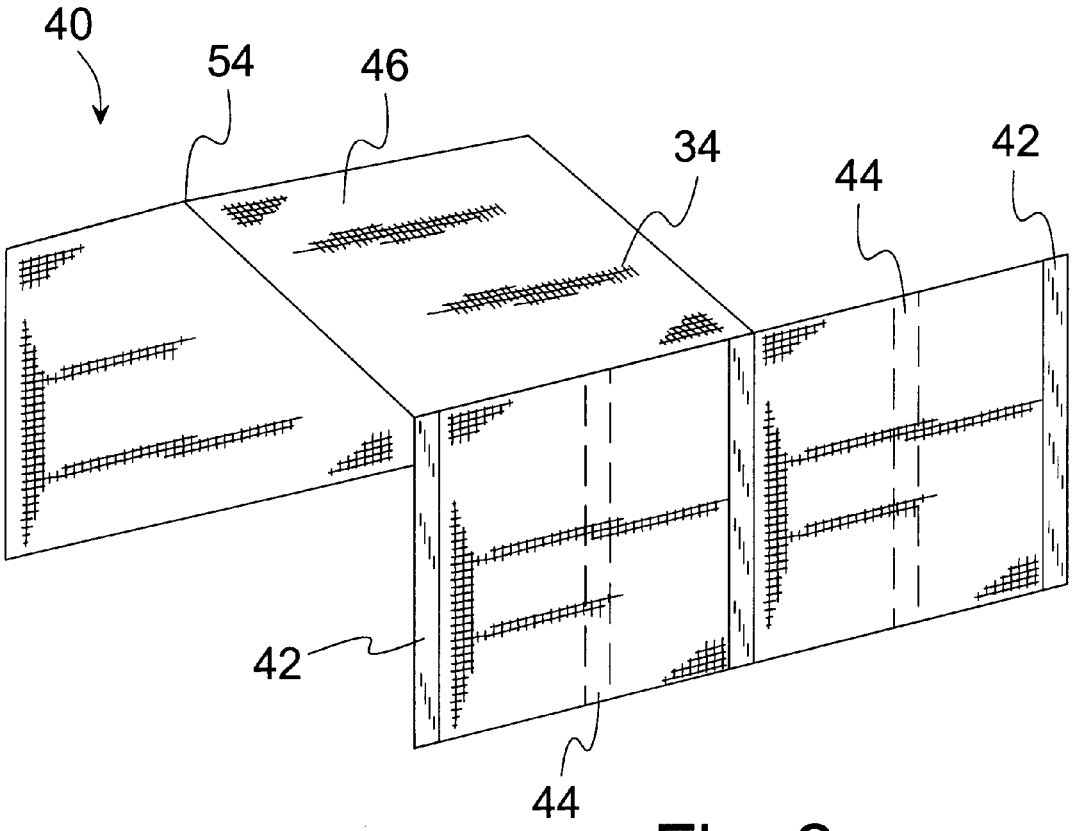
FIG. 2 is an isometric view of a building shell at a subsequent stage of construction, employing alternating offset post members.

With or without pretreatment, the fabric 32 is treated with the principal coating layer 34 to form a structural shell. After principal treatment, the treated net holds a fixed shape without continued need for the framework 30, as shown in FIG. 2. The net is treated by applying a layer 34 of surface treating agent such as cementitious material. A suitable method of application is, for example, by spraying onto the net. A material that hardens, cures, or sets can be a suitable agent to treat the net and define layer 34. Unlike the pretreatment coating that might be of minor thickness, the principal coating is of substantial thickness and continuity. The net layer 32 and the coating layer 34 may become integrated. A single numeral 35 will refer to a combined or integrated unit that includes both a fabric portion and a principal coating portion.

Figure 10:
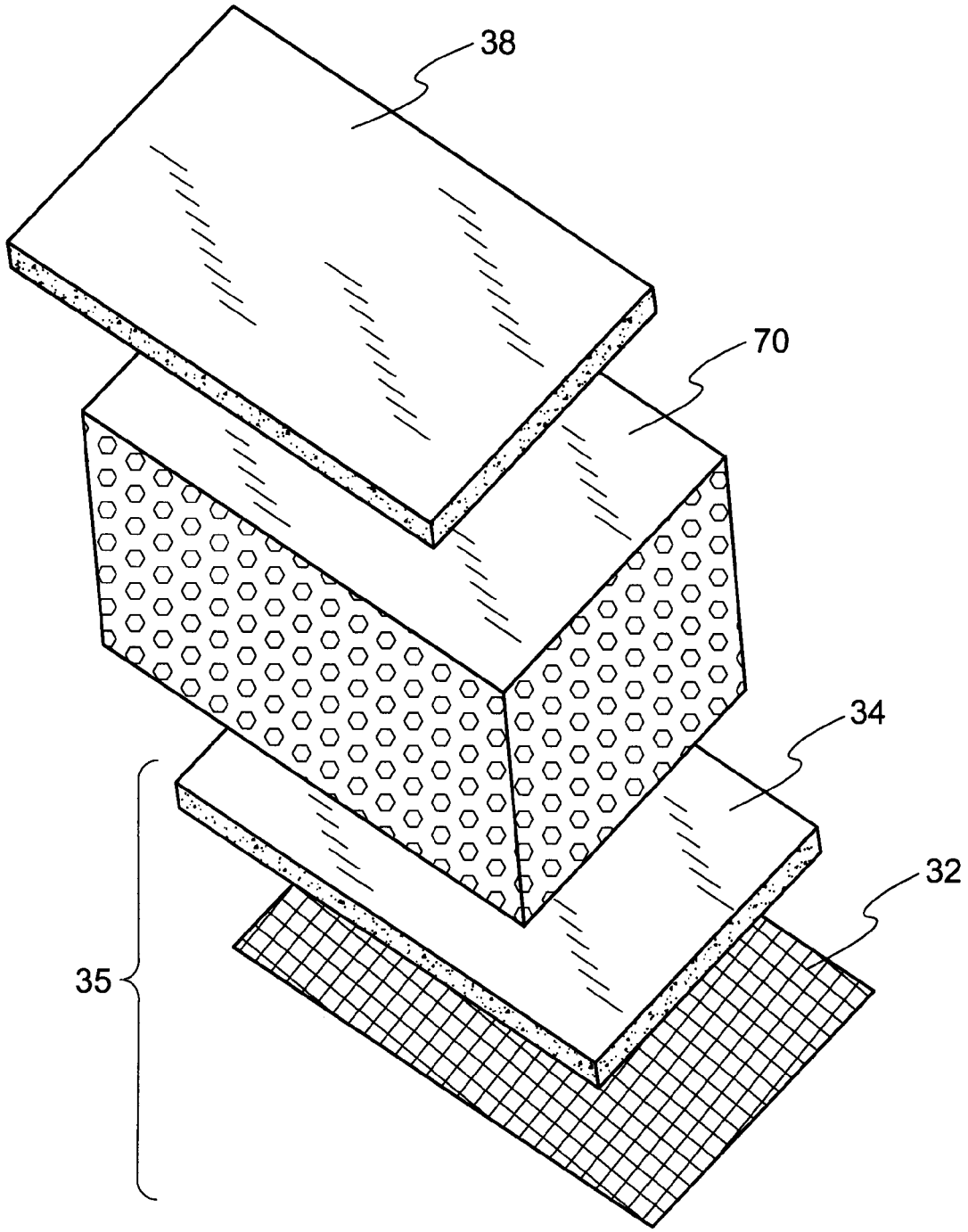
FIG. 10 is an isometric assembly view showing layers of any component of building construction.
Figure 11:
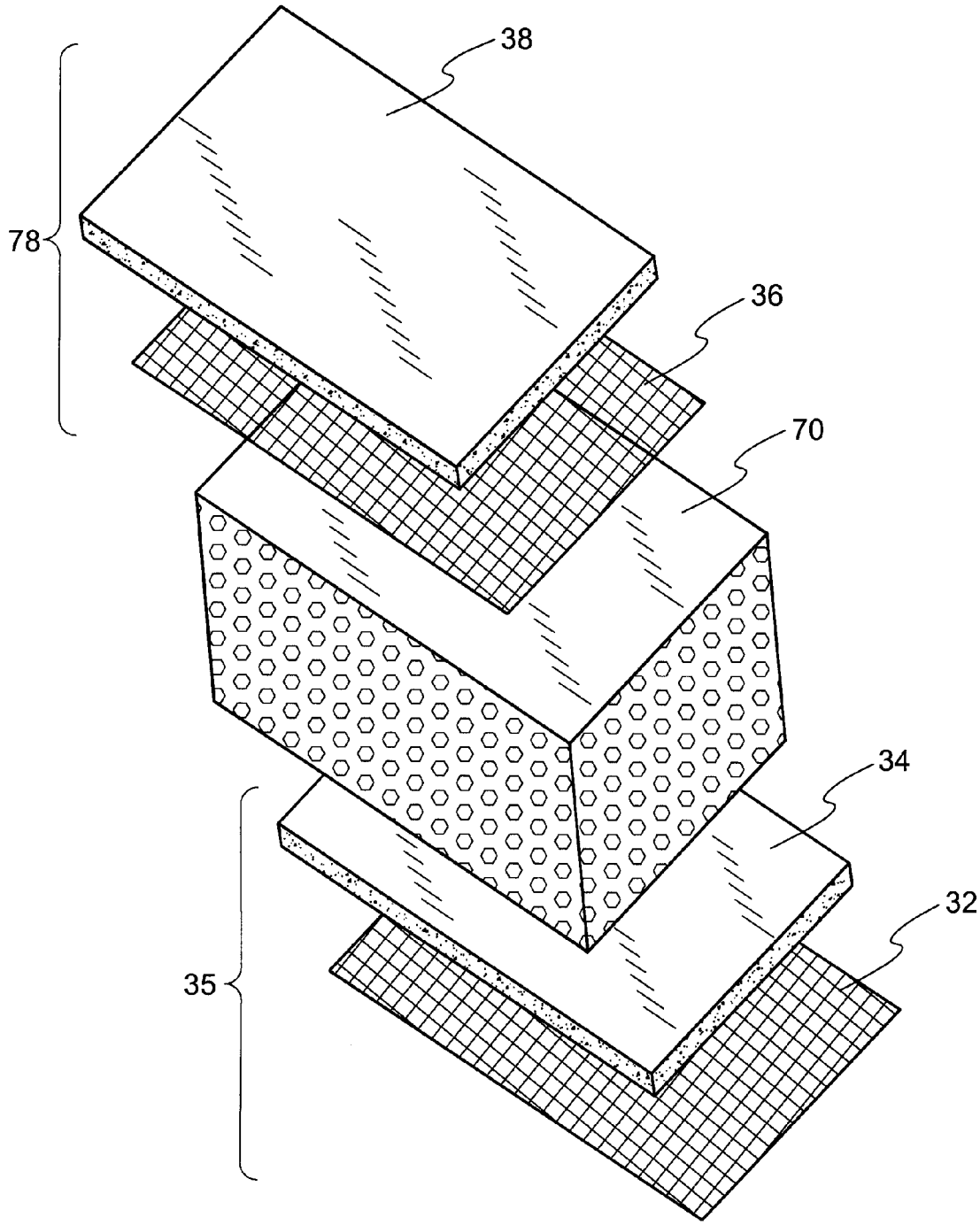
FIG. 11 is an isometric assembly view showing layers of any component of alternate building construction.

In the arrangement of layers as shown in FIGS. 10 and 11, the applied principal coating material can form a structural layer 34 that is initially applied in juxtaposition to net 32. Because the layer 34 will require support until it sets or otherwise becomes self-supporting, the net 32 can be stretched taut and attached to framework 30 as needed, as best shown in FIG. 1. Known fastening systems such as staples, nails, ties, and adhesives are suitable to secure the net 32 with stretched tautness on frame 30. Optionally, the net 32 is applied to the frame using gravity as the primary means to plumb the fabric walls.

The composition of framework 30 is variable according to cost and availability of supplies. Conventional wood framing members can be used, although the framework does not require the close spacing of a conventional stud wall. By way of example and not limitation, other candidate materials include metal pipe, plastic pipe, expanded polystyrene (EPS), bamboo sticks, steel rods and beams, aluminum rods and beams, and inflatable tubing, including tubing constructed from fire hose and then pressurized. The framework 30 might be removed or removable. Alternatively, it may be preferred for the framework 30 to be retained in place as a permanent component of the building structure, even if the resulting structural benefit of the framework is small.

Figure 17:
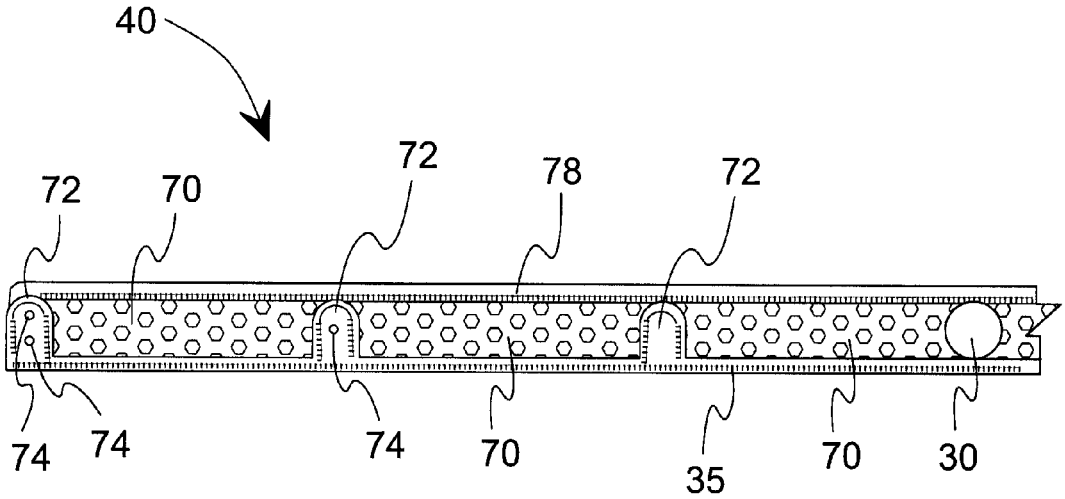
FIG. 17 is a horizontal cross-sectional view of a sixth embodiment of shell section structure.

In optional variations of structure such as shown in FIGS. 11 and 17, the framework 30 is utilized to support multiple layers of fabric and principal hardening agent. A first layer of the net 32 is followed by a layer 34 of principal treating agent, which upon curing forms a self-supporting structure that is capable of receiving and supporting further structural layers. Thus, the cured first layer 35 receives and supports a second layer 36 of the net, which may be either of the same or different composition from layer 32. The second layer 36 receives a second layer of a principal coating 38, which may be of the same composition or different composition from layer 34. For example, the second layer may form an exterior skin over the building and may have a mix design suited to reflect heat. Each layer 35 of a combined fabric and hardening agent becomes structural upon curing. Accordingly, multiple layers 35 can be added in series, as desired.

After the principal coating layer 34 has been applied to the net 32 and the net has been hardened, framework 30 may removed, as suggested in the view of FIG. 2. The resulting first structural skin or shell 40 may be a building constituting a first end product. In order to form a desired exoskeleton building structure, the first shell 40 should be coated with an intermediate layer 70, and a second shell should then be added to cover the intermediate layer on the side opposite from the first shell 40. The building shell 40 serves as a mold for application of one or more additional layers of net 32, cementitious principal coating 34, and the like, to define a finished exoskeleton structure. Supplemental principal coating layer 38 of FIG. 10 is an example of a second skin of an exoskeleton building.

The intermediate layer 70 may be formulated to constitute an internal structural member, spacer, or insulation. As noted above, a spacer is an important element of an exoskeleton structure. There are well known formulas for computing moment of inertia of any beam or assembly. Increases in the moment of inertia are proportional to increases in the depth of member. Thus, the stated moment is increased as the distance between the center of the walls, roof, and floor, to the exterior structural member or skin is increased.

The method of this invention enables the on-site modification of building design, including both architectural design and load capacity. The thickness of layer 70 establishes the depth of beam of the exoskeleton, which is a critical factor in adapting the building structure to various loading situations. Varying the thickness of layer 70 is possible during on-site construction to accommodate changes or newly obtained requirements for the building structure. Similarly, by adding an additional layer of net and fixing material to either or both of the skins of the exoskeleton, it is possible to increase the tensile and compressive capability of the skins while at the building site.

Another optional embodiment employs structural supporting members 42 such as posts or other columns, illustrated in FIG. 2 as being positioned against the outside surface of shell 40. In a further illustrated variation, structural posts or columns 44 are arranged in alternating and offset positions on both the inside surface and outside of shell 40. The structural elements 42, 44 may be arranged in an alternating pattern. As described in greater detail below, a second skin of an exoskeleton structure may overcoat the elements 42, 44 to incorporate them into the exoskeleton as a unitary or monolithic unit.

Figure 9:
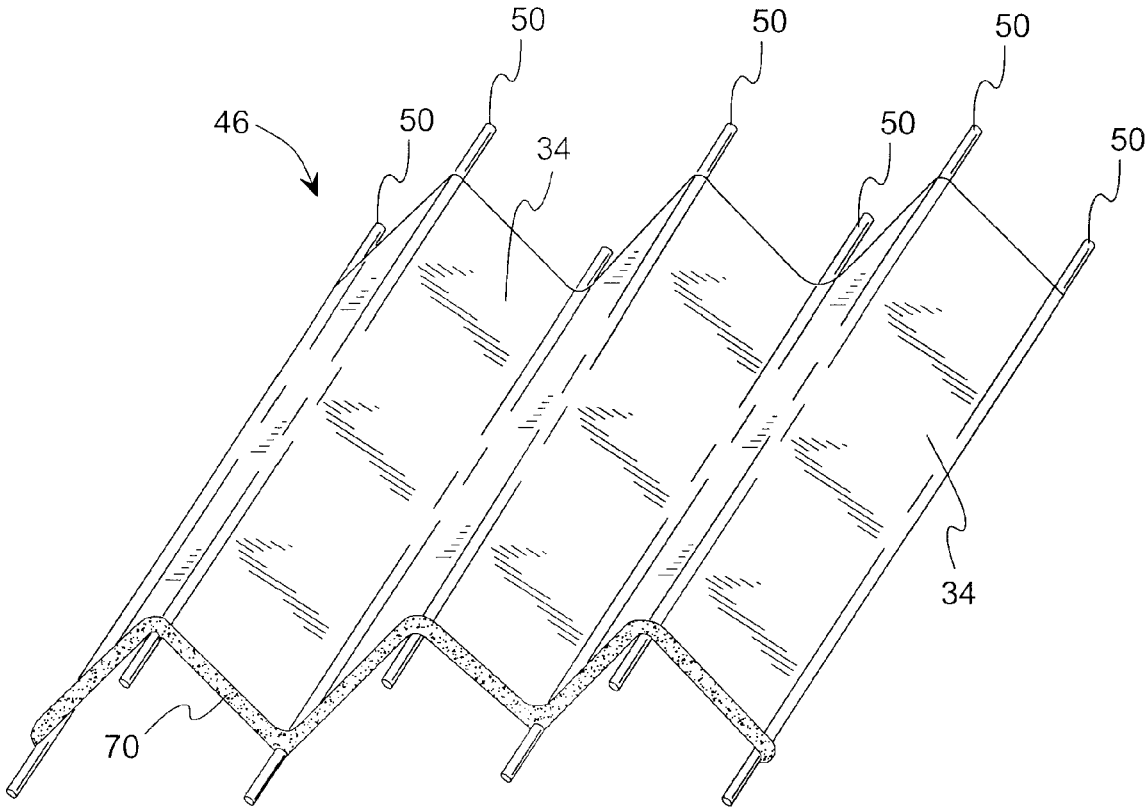
FIG. 9 is an isometric view of the roof of FIG. 3 during a further step of construction.

A hardened net 32 may define a roof 46. Before hardening, the net is applied to roof fabric supports 48, FIG. 1. If the fabric is applied in tension, the net will define the shape of a flat roof or flat roof panel. A roof panel 46 provides a useful example of how easy and cost effective it is to increase the strength of exoskeleton, even on-site during construction. In a situation where the roof panel 46 must bear only limited load, a flat panel 46 as shown in FIG. 2 may have sufficient structural capability that it needs no additional coating other than the fixing agent 34, forming a single flat shell wall 35. In a situation where the roof 46 has more load, the exoskeleton formed of shell layer 35 plus intermediate layer 70 plus opposite shell layer 78 provides greater load bearing capability. In the more extreme situation where roof panel 46 needs even more strength or where span is great, the exoskeleton roof panel composed of layers 35, 70, and 78 can be reconfigured into a folded plate design such as shown in FIG. 9, or into another panel shape that adds even more depth of beam plus rebar for increased tensile requirement. This sequence of increasing the capability of a roof is representative of increased capability that can be applied to any portion of a building structure. The load bearing capability of a structure can be increased without requiring the typical delay and added cost of ordering and obtaining larger or additional joists, trusses, or the like according to conventional practices.

Figure 3:
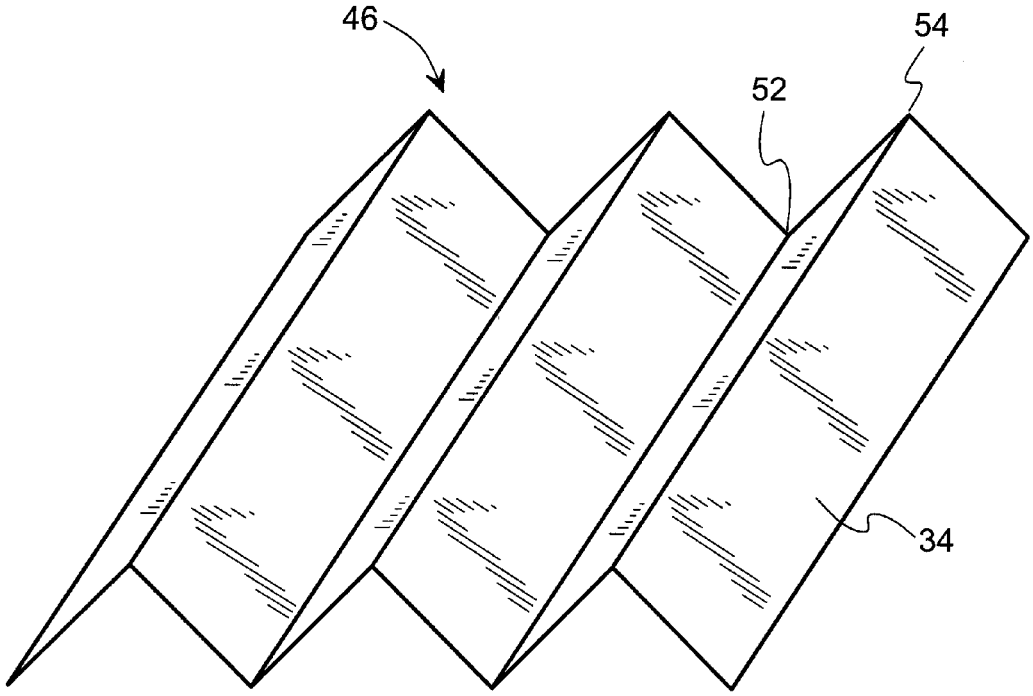
FIG. 3 is an isometric view of an embodiment of a roof.
Figure 8:
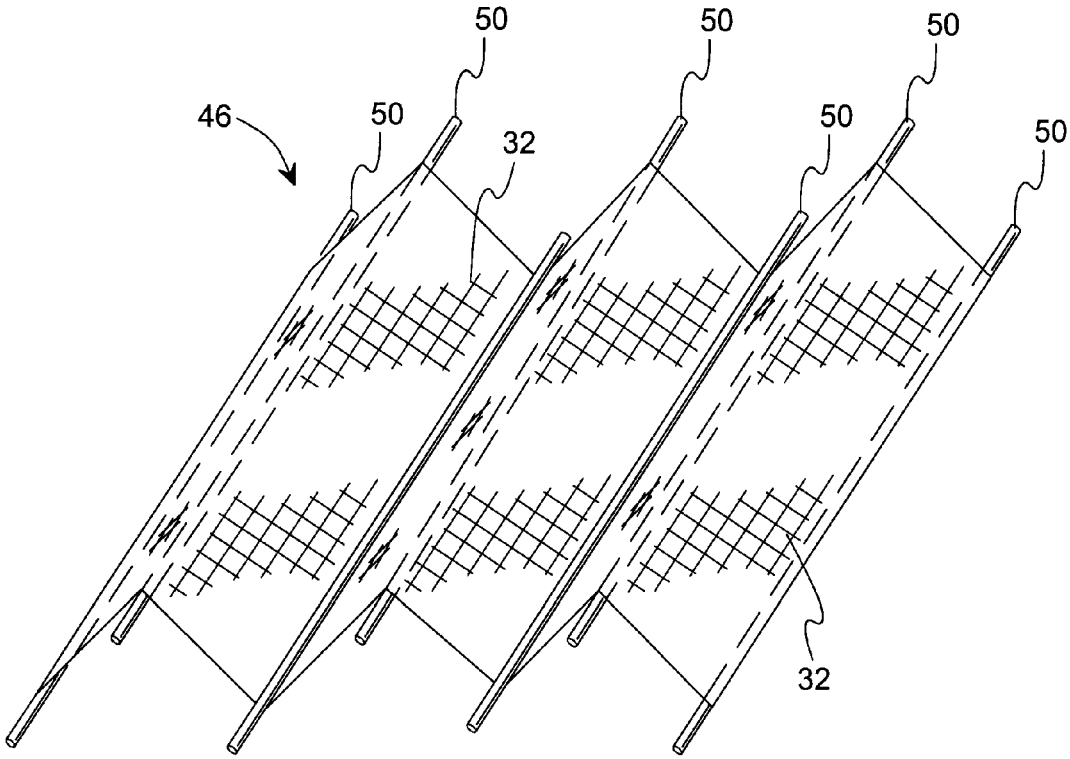
FIG. 8 is an isometric view of the roof of FIG. 3 during a step of construction.

A folded plate is a series of triangular peaks and valleys as viewed in profile, visible in FIGS. 3, 8, and 9. According to the method of construction shown in FIG. 8, net 32 is applied to parallel elongated transverse roof supports 50 arranged in alternating high and low positions. Steel rod such as rebar is a suitable choice for use as supports 50. Another suitable choice is a flexible elongated member such as a cable, rope, or the like, having suitable tensile capacity if required for loading or span.

One method of applying net 32 to supports 50 is by weaving the net over the high supports and under the low supports. Another method is to lay the net over a series of high supports, allowing slack net between the high supports. The low supports can be dropped onto the slack areas to form troughs under force of gravity. Various known fasteners and attachments such as hog rings may be used as required to attach net to supports, such as at high supports, at every support 50, or at the ends of the net 32, at the final or end supports 50. According to FIG. 8, the fabric layer 32 is configured to a structural shape by the supports 50, which can serve as either an additional structural element or the only structural element.

The net 32 on roof 46 is hardened by application of a coating layer 34, such as a cementitious or polymeric coating layer 34 to form the base layer of finished roof 46, FIG. 9. The layer of treating composition 34 applied to the fabric 32 hardens to set the fabric in a permanent shape. In order to form an exoskeleton structure, an intermediate spacer layer 70 is placed over the base layer of net and hardener; and a second layer of net and hardener is placed over the intermediate layer 70. The layer of treating composition 34 can be built up or thickened over the rebar 50 to further enhance the integral strength of the structural elements in assembly with the fabric 32. The lower supports 50 can be fully encased by the hardener 34.

The resulting triangular profile of the roof section 46 has inherent structural capacity even with rebar support removed. FIG. 3 shows the resulting roof 46, with a connected series of flat roof segments at acute angles to one another defining troughs 52 and peaks 54. Thus, the rebar supports can serve as another variety of a temporary framework that holds a fabric or net in discipline or desired shape. Application of a single layer of net 32 and a layer of cementitious material 34 can complete the roof structure. Alternatively, the roof 46 of FIGS. 3 and 9 may serve as a mold that allows application of one or more additional layers of net 32 and treating material 34, described above.

Figure 4:
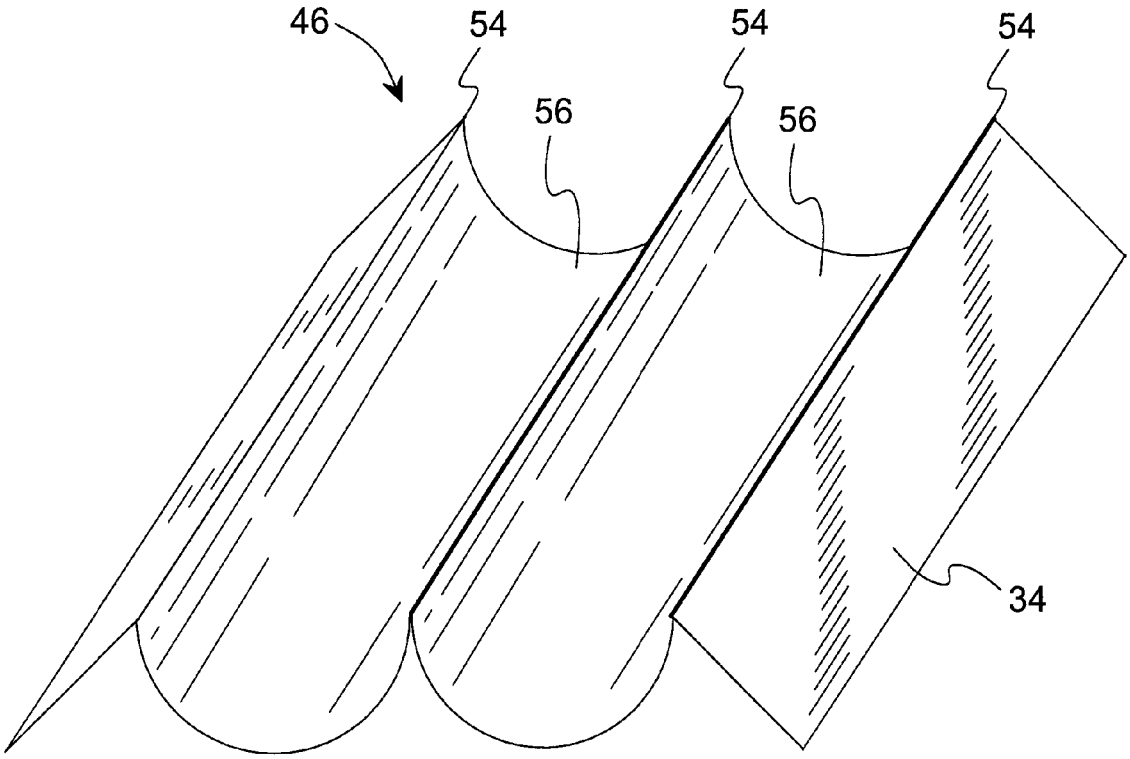
FIG. 4 is an isometric view of another embodiment of a roof.

Another embodiment of the roof 46 omits the low position supports 50 of FIGS. 8 and 9, other than at the ends of the roof where ends of the fabric might be secured to low position supports. FIG. 4 shows a resulting roof section after it has been hardened or frozen to shape. With the low position supports 50 absent, the intermediate troughs of the roof 46 are curved between pairs of upper supports 50 at a selected height. The resulting curves 56 may be referred to as catenaries. The curved troughs have inherent structural capacity. Catenaries are considered to be among the strongest shapes to be placed under tensile stress across a span between ribs.

For calculation purposes, the depth of the catenaries corresponds to the depth of a structural member or beam. For example, the beam depth in FIG. 4 can be measured as the vertical distance between the top of a peak 54 to the low point of the catenary 56. Any number of domes or other suitable repeating shapes can be utilized to provide structural capacity, with or without additional structural elements. In each case including the folded plate, trough depth of the hardened fabric corresponds to beam depth. Either temporary or permanent framework or exoskeleton will establish the trough shape.

Where said roof section meets a wall, an alternate approach is to have the wall define the depth of the section at the juncture. The depth may be minimal, causing the catenary to have a compound catenary shape. The shape may be a finished roof section, or the shape may now be utilized as a mold for additional layers of materials as suggested in FIGS. 10 and 11.

A roof of the type described is suited for use on both rectangular structures and non-rectangular structures. For example, the roof is adaptable for use on round, elliptical, or various polygonal structures. Parallel arrangement of supports 50 may be preferred for use on rectangular roof areas or to produce individual rectangular roof segments. Converging radial or modified radial arrangement or segments may be preferred on rounded and irregular roof areas. In an appropriate situation, the roof may be formed of a body of hardened net 35 having no supports 50 other than at ends, as better shown and described in connection with FIG. 18.

Figure 5:
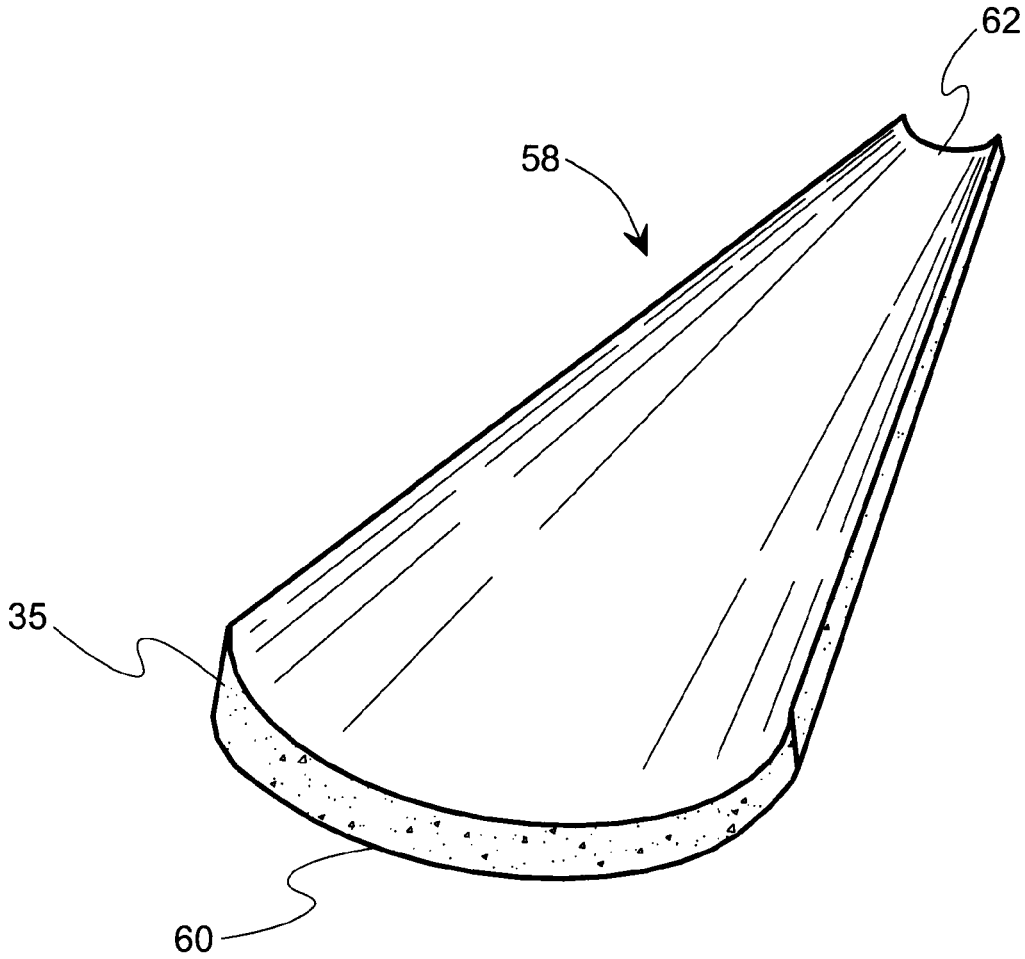
FIG. 5 is an isometric view of a curved roof segment.

FIG. 5 shows a segment or modified vault section 58 of a rounded roof. The modified vault section includes both a wider end 60 and a narrower end 62, wherein the wider end typically is nearer the periphery of the roof and the narrower end typically is nearer the center. The roof segment 58 is configured as a modified vault with inherent compressive load bearing capability. A method of forming the roof section 58 is by draping a fabric sheet between supports 50, FIGS. 8 and 9, such as of rebar. The fabric sheet assumes a catenary shape. Treating the surface of the fabric with a spray of hardening substance produces a hardened body 35 of the structural roof element.

Figure 18:
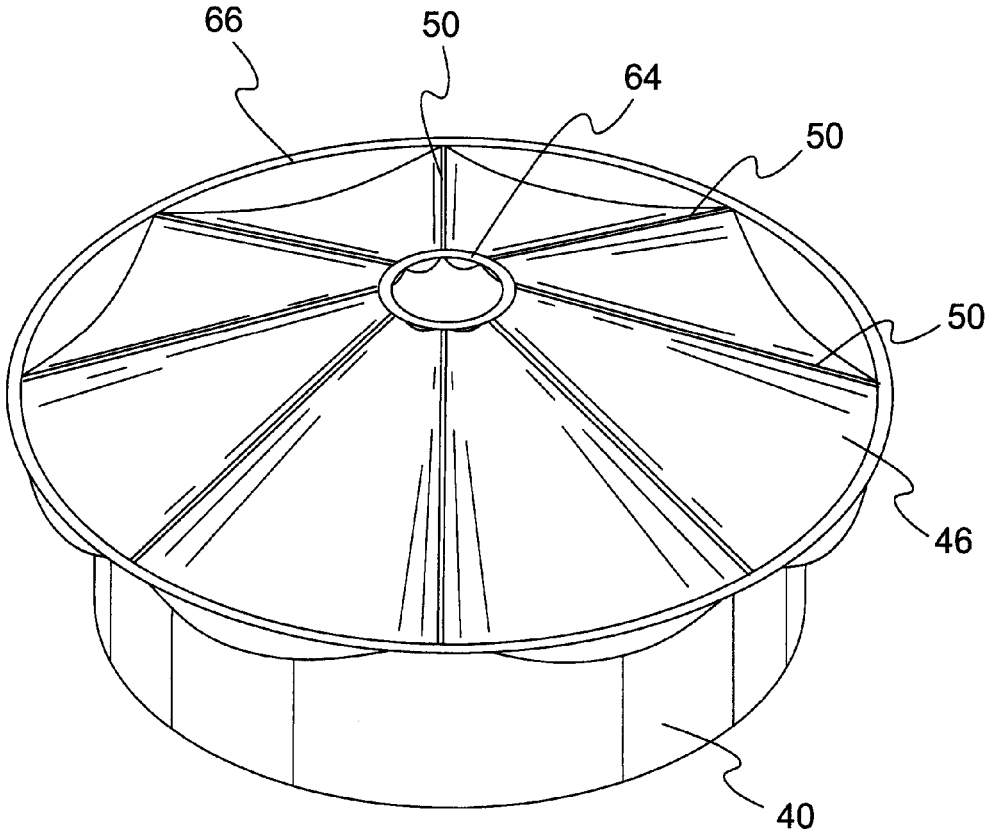
FIG. 18 is an isometric view of a building with radiating roof supports.

The roof segment 58 can be repeated as necessary to define an entire circular, elliptical, or other rounded roof by arranging the supporting elements 50 in a radiating or radial pattern, as shown and suggested by FIG. 18. For example, a ring-like center compression element 64 may support one end of radiating rebar supports 50, and a ring-like peripheral or exterior tension element 66 may support the other end of the rebar members 50. The exterior element 66 may be of another shape as required, such as an ellipse, arc, polygon, or polygonal section.

The availability of a choice between parallel or radiating supports 50 or the substantial non-use of supports demonstrates that the roof system is adaptable to substantially any shape of building. The invention contemplates the use of all permutations and combinations of parallel, nonparallel, radiating, and other arrangements of supports. The fabric or net 32 draped over the supports 50 may be treated to form a finished section 35; or the initial section 35 may serve as a mold for additional layers 35, 70, and 78.

Figure 6:
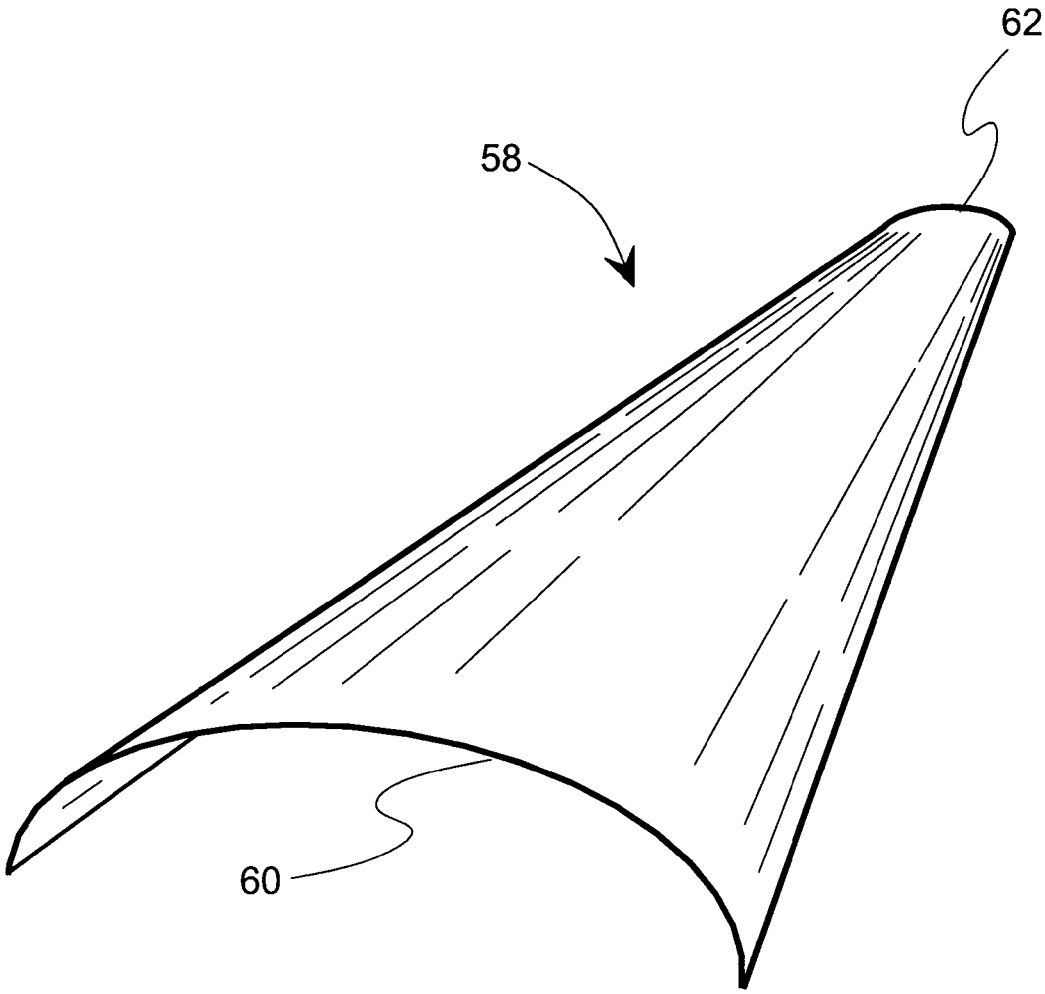
FIG. 6 is an isometric view of an inverted curved roof segment.

Roof segments 58 can be used either as downwardly dished or troughed segments such as shown in FIG. 5 or upwardly convex or domed segments as shown in FIG. 6. A domed segment can be fabricated by forming a dished segment and inverting it. Alternately, the domed segment is fabricated by draping fabric over a positive mold, such as one formed of expanded polystyrene, to hold fabric layer 32 in shape until frozen by a layer of treating agent 34. The mold may be retained under the roof segment or removed. Optionally, the mold may have structural or insulative characteristics.

Figure 7:
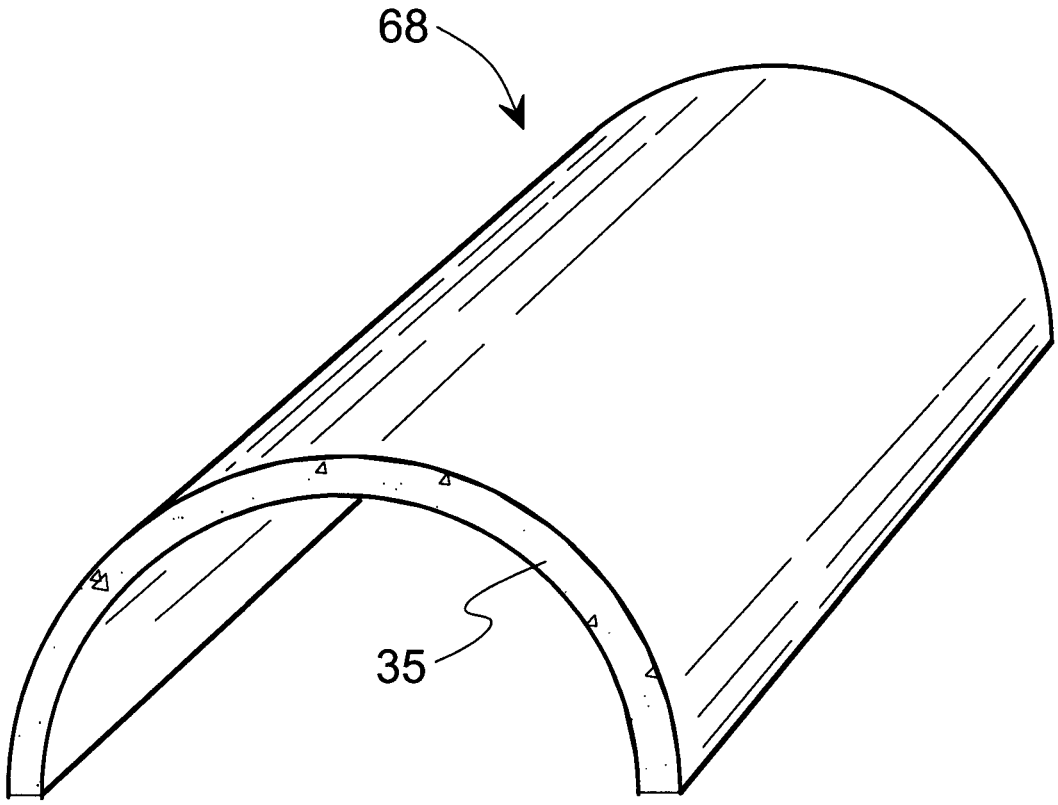
FIG. 7 is an isometric view of a vault shaped roof segment.

Another configuration for a roof segment is the vault 68 shown in FIG. 7. These segments 68 can be fabricated by draping fabric 32 over a framework as described in connection with FIG. 4. The fabric assumes a natural curve. Cementitious material 34 is applied to the fabric 32 and allowed to harden to form the curved shape of the segment 68. The curved segment 68 is inverted for use as the upwardly domed vault of FIG. 7. The vault shape also can be fabricated in multiples, as suggested by the multiple troughs 56 of FIG. 4. The multiple curved troughs 56 are turned upside down to produce a multiple vault. A single wall 35 may form a finished vault 68. One or more additional layers 35, 70, and 78 can be added, either while the vault is in the troughed position of FIG. 4 or after inverted to the dome or vault position of FIG. 7.

As evident from the disclosures of FIGS. 3-7, a roof 46 can be fabricated by forming structural members 35 of net 32 draped or woven on elongated supports 50 and treated with a layer 34. The net 32 may be snug or loose between supports. The area of roof between a pair of supports may be termed a segment, which optionally includes the pair of elongated side supports 50. If loose, the net 32 may form smoothly curved troughs. Segments may be formed individually or in groups. The supports 50 may be parallel or non-parallel, and non-parallel versions may include radial or radiating arrangements. The resulting segments will have parallel sides or non-parallel sides, according to the arrangement of the supports 50. Multiple joined segments or groups of segments may be combined to define a roof 46.

The multiple segments might be formed as a compound unit as suggested by FIGS. 8 and 9 or as individual segments that are combined in juxtaposed relationship to form a roof 46. In either form, the segments can be used in original, gravity-dictated disposition or in inverted disposition; the latter being of particular interest where an upwardly domed vault 68 or modified vault 58 is the desired structure. Segments of any or all shapes can be individually combined to form complex roof patterns. Any segment design is capable of use in original disposition or inverted disposition. Any segment is capable of use with its ends reversed, such that, for example, the tapered segments 58 can be alternated in series by reversing ends 60, 62 in any desired frequency or pattern. Especially where individual segments are assembled to form a roof, it is desirable to apply a unifying layer of fabric 32 and a layer of hardening coating 34 of the assemblage.

Variations in the layer structures are possible and expected. The composition of the flexible net 32 may be of woven or sheet material. Candidates include stucco netting, landscape cloth, steel chicken wire, hardware cloth, basalt net, or aluminum screen. The composition of the cloth or netting may be natural or synthetic, including plastics and composites. Examples of suitable materials include nylon, high-density polyethylene (HDPE), low-density polyethylene (LDPE), polypropylene, and woven plant products such as grasses, reeds, and leaves. The net 32 can be a structural component of the finished building, or, optionally, in some situations it may be removable. In the latter situation, the net may be utilized only for purpose of being a temporary method that holds or defines a shape for the cementitious material of layer 34. After layer 34 hardens, the net might be removed, leaving the layer 34 to serve as a residual structural element and as a mold for receiving and shaping subsequent layers.

As shown in FIG. 10, a polymeric, cementitious, or other hard setting principal layer 34 is applied over the net 32. Cementitious materials include Portland cement and materials sharing similar chemistry of hydration. Other cementitious materials include geopolymers that are formed by the chemistry of polycondensation. Typically the principal hardening layer 34 will penetrate and bond with the net layer 32 such that the net is not removable. Suitable materials for use in the principal hardening layer 34 will cure or set by passage of time or other methods. Both slow setting and fast setting materials are known. Accelerators may be used as desired. A suitable set time might range from several seconds to several hours.

A shell 40 or other component of a building formed according to the invention may constitute an exoskeleton assembly. The hardened layer 34 defines a first external structural skin of the exoskeleton assembly. Preferably, a second external structural skin is added, consisting of at least the second hardened layer 38. In the case of compressive shapes such as vaults or domes, the inner layer 34 need add little or no structural capacity—it simply may act as a mold.

Principal hardened layer 34 may contain fibers that impart structural characteristics to the layer. Other optional ingredients include silica fume, plasticizers, or micro fibers added to the cementitious mix design. Suitable components for inclusion in the mix design are ceramic spheres, which may be synthetic or natural as present in some ashes; polymers; corn or corn derivatives, which may be by-products of processing; magnesium, such as magnesium oxides; phosphates; micro fibers, which may include round or ring shaped fibers; recyclable wastes; and other processed waste materials including phosphogypsum and mine or mill tailings. Other suitable additions include air or other materials among which may be: cements; synthetic or natural ceramic spheres; expanded polystyrene (EPS); soils; polymers; plasticizers; gelling additives; ashes such as of coal ash, rice hull ash, corn ash, bagasse ash, volcanic ash, or others; pumice; magnesium oxides; phosphates; fine powders such as calcium carbonate, waste gypsum or phosphogypsum, mine or mill tailings; and processed recyclable wastes.

In addition to layers of netting and principal hardening materials applied to the netting, an exoskeleton building construction should include one or more additional intermediate layers 70, shown in FIGS. 10 and 11, which may be a filler layer, a strengthening layer, or an insulating layer. A base layer, skin, or shell wall 35 acts as a backer board or mold to accept and provide shape or control for the applied layer 70. Among suitable methods for applying layer 70 are pneumatic application, spraying, and pumping. Layer 70 may be stacked on or against a base layer 35, using a minimal slump mix design. With a troughed roof 46, such as shown in FIG. 9, layer 70 may fill the troughs to establish a smooth or flat roof, which then can be coated with an external finishing layer 35, 78.

Where layer 70 is applied to add spacing or depth to a building structure, layer 70 may be formed of honeycomb material that provides depth of structural element or beam. Optionally layer 70 is composed of expanded cementitious materials, for example expanded by air. The material forming the layer 70 may contain air or other materials among which may be: cements; geopolymers; synthetic or natural ceramic spheres; expanded polystyrene (EPS); soils; polymers; plasticizers; gelling additives; ashes such as of coal, rice hulls, corn, bagasse, volcanic, or others; pumice; magnesium oxides; phosphates; fine powders such as calcium carbonate, waste gypsum or phosphogypsum, mine or mill tailings; and processed recyclable wastes. Such materials may be used as a base raw material for a mix, or to expand a cementitious mix, regardless of whether they provide significant structural strength. The materials may have inherent compressive and tensile characteristics by themselves. The composition of layer 70 may offer insulating values to the building structure.

For economic and environmental advantage, layers 34, 38, and 70 may be fabricated from indigenous, low cost or freely obtainable materials, especially recyclable materials. Certain suitable materials may be an environmental liability to others. After such materials are detoxified, they form suitable components for use in the invention and need not be buried or otherwise stored. Some of the materials otherwise must be sent to landfill or disposed of in a manner that incurs costs. The ability to make beneficial use of such materials creates a profit center. The materials chosen are selected for utility in the invention and not on the basis of whether they are recognized by building codes or engineering standards. Likewise, it is optional whether such materials contribute significant compressive or tensile strengths.

In FIGS. 10 and 11 a hardened second layer 38 covers layer 70. This layer is an outer structural shell or skin of an exoskeleton assembly. Layer 70 provides depth of beam or strength by increasing the space or moment of inertia for exterior exoskeleton skins in the wall, floor, or roof. Layer 70 may be formulated to provide insulation. Where several layers of the assembly are built up, layer 38 may be the exterior skin or finish coat of the built up assembly. Components of layer 38 may include ceramic sphere admixtures that impart qualities of an effective sound barrier and a high level of emissivity or reflectivity to the material. Corn-derived admixtures are desirable to impart a high level of emissivity, reflectivity, or thermally non-conductive characteristics to the material. Fibers can impart structural characteristics to the layer 38, adapting it as the final layer of an on-site, built up, and structural exoskeleton assembly.

As shown in FIG. 11, an additional layer of net or fabric 36 can be utilized in the outer layer or skin of the exoskeleton assembly. The layer 38 can be a hardening layer applied to the fabric 36 to form a combined layer 78. The qualities of the external layer can be chosen according to environmental constraints. For example, materials such as ceramic spheres, corn products, and gold are known to impart high reflectivity, which is beneficial to stop heat transfer. The inner layer 34 also can be adapted to local need according to the choice of added components.

Figure 12:
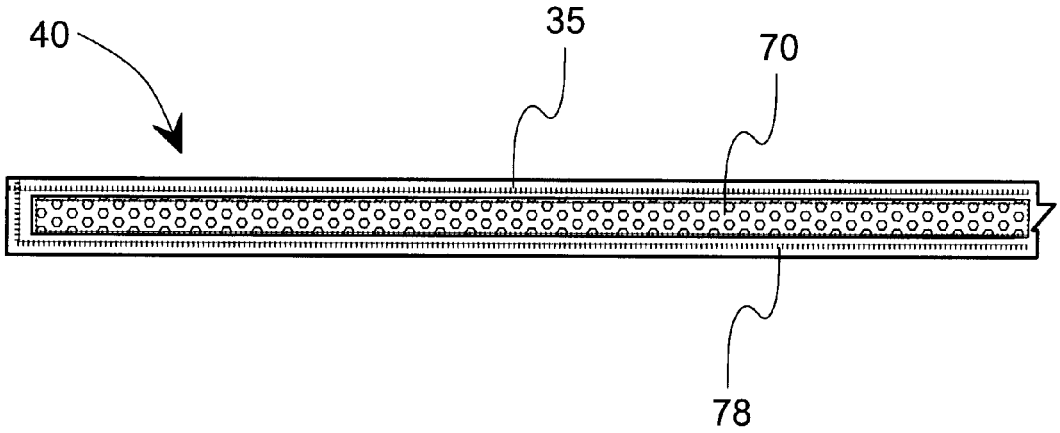
FIG. 12 is a horizontal cross-sectional plan view of a first embodiment of shell section structure.

FIGS. 12-17 show examples of sections of a shell 40 using the described variations of the invention. FIG. 12 shows a shell section 40 made in accordance with FIG. 11. On one side, a surface layer 35 is formed as illustrated in FIG. 11 of net 32 and hardened material 34 and covers a core layer 70. An opposite surface layer 78 is formed of as illustrated in FIG. 11 of net 36 and hardened layer 38.

Figure 13:
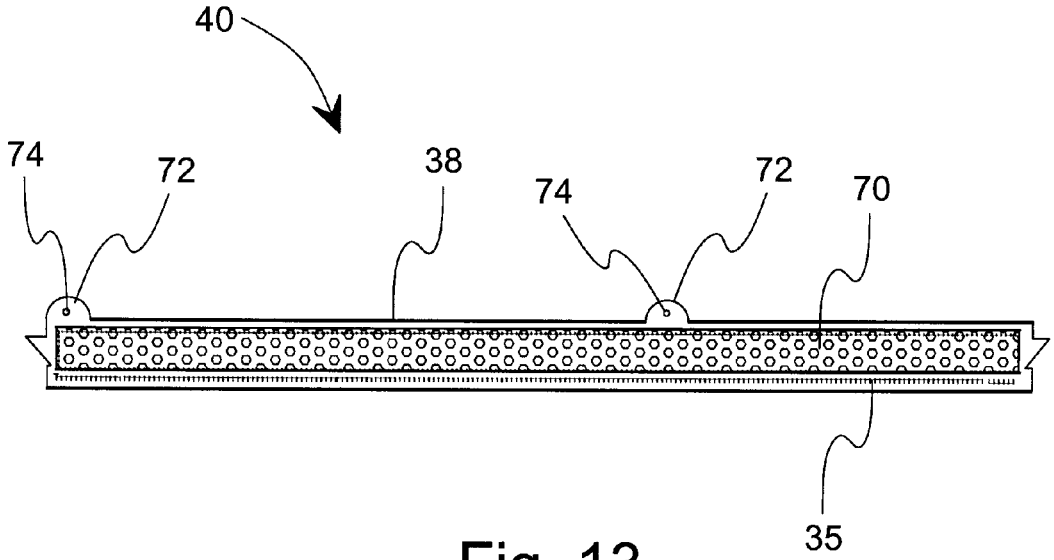
FIG. 13 is a horizontal cross-sectional view of a second embodiment of shell section structure.

FIG. 13 shows a shell section 40 made in accordance with a modification of FIG. 10. A structural element 72, such as a post, is monolithically incorporated into the material of an outer layer 38. A method of placing this layer is by casting, spraying, or otherwise applying the coating in situ. The structural element 72 may be built around another element such as a length of steel rod or rebar 74 within element 72. Examples of other possible included elements 74 are prefabricated reinforcements and members formed, in whole or in part, of wood, steel, basalt, aluminum, or bamboo. The use of built up layers enables the element 72 to be an integral structural component of the shell. Elements 72 can be posts 30 of the initial support structure, FIG. 1. These posts 30 include outer posts 42 and inner posts 44, FIG. 2, which may be opposite from one another or spaced alternately on one or both sides of a wall.

Figure 14:
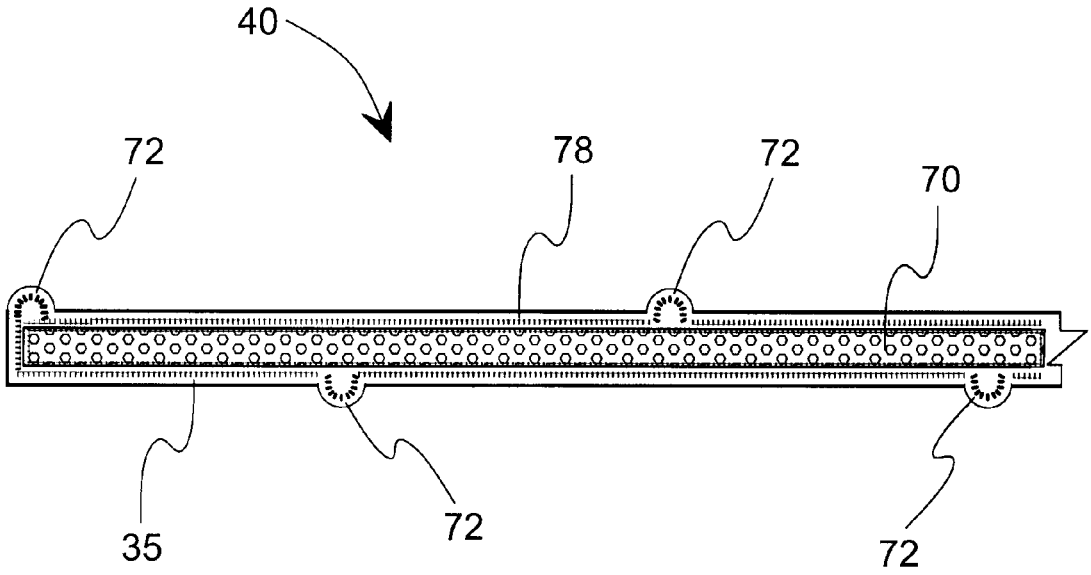
FIG. 14 is a horizontal cross-sectional view of a third embodiment of shell section structure.

FIG. 14 shows a shell section 40 built in accordance with a modification of FIG. 11. An inner shell surface 35 covers one face of the wall, and an outer shell surface 78, including both fabric 36 and principal coating 38, covers the opposite face. The composition of shell surfaces 35 and 78 may be identical. Structural elements 72 are fabricated as a monolithic part of both shell surfaces. Net 32, 36 is a component of the respective shell surfaces and is embedded in or overcoats the elements 72. The principal coating layers 34 and 38 also overcoat the elements 72. The elements 72 are arranged in offset alternating pattern taught in U.S. Pat. No. 5,566,521.

Figure 15:
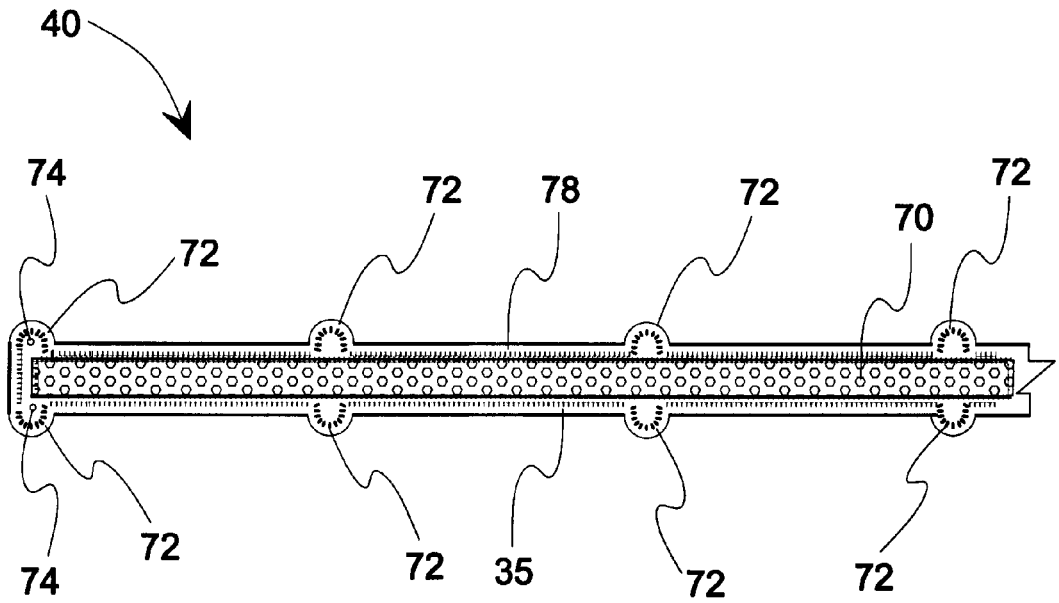
FIG. 15 is a horizontal cross-sectional view of a fourth embodiment of shell section structure.

FIG. 15 shows a shell section 40 in which the outer shell coating 78 includes both an integrated net 36 and principal coating 38 applied as an overcoat over integrated structural elements 72. The elements 72 are arranged in a juxtaposed configuration, directly across from one another on opposite sides of the section. At least some of the elements 72 include steel rod or rebar 74 bearing a point load. For example, the rebar 74 may be included in elements 72 at the end of the section or under the end of a window or door header.

Figure 16:
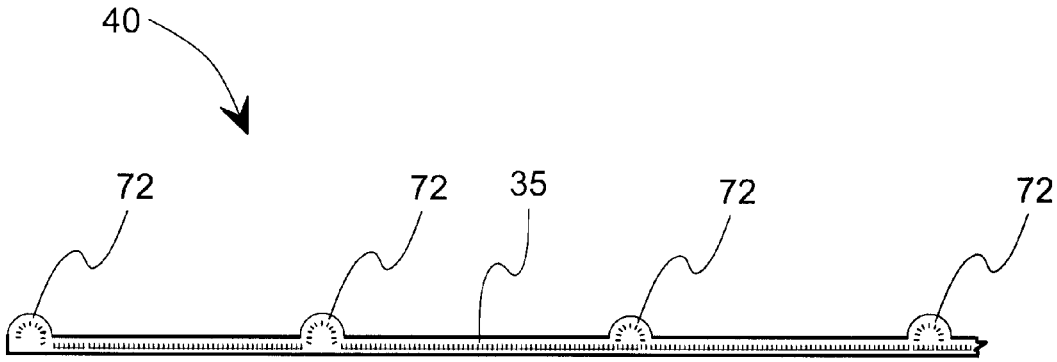
FIG. 16 is a horizontal cross-sectional view of a fifth embodiment of shell section structure.

FIG. 16 shows a shell section 40 formed of the single integrated layer 35, which utilizes only net 32 and first hardener 34 as shown in FIG. 10. Optional structural elements 72 are arranged on at least one side of the section. The net component of unit 35 is incorporated into the elements 72. For example, the net component may deviate from planar arrangement to overcoat the elements 72. As another example, the net component may wrap or encircle elements 72, such that the net component is located on both inside and outside edges of the elements 72. The hardener element of unit 35 is applied to the net to form an integral section 40 formed of both shell and optional structural elements. Any previously described placement or arrangement of structural elements 72 can be utilized.

FIG. 17 shows a shell section 40 that functions as a mold. One major side of this section 40 is formed of a shell wall 35, which forms a first side of a two-sided exoskeleton. The opposite major side is formed of shell wall 78. The two major sides are spaced apart but closed at opposite ends, defining an intermediate core area. The resulting structure of the shell section is a suitable vessel or traditional mold assembly for receiving a quantity of material suitable for forming intermediate layer 70 into the intermediate core area. Material for layer 70 can be placed in the core area as a flowable liquid that will set or solidify. Structural elements 72 are incorporated into one of the shell sides 35. The net in this shell side 35 may wrap, overcoat, or be incorporated into the element 72. The element 72 can be built up monolithically with the net.

The novel method of forming the building section of FIG. 17 is, first, to establish the shape of the net for forming a first or inside layer of the shell 40. Second, the net is hardened or fixed by application of a fixing to the net, thereby forming finished shell wall 35. The net and coating becomes a unified inside layer 35. The layer 35 is a tensile and compressive structural surface of the exoskeleton. Layer 35 can be a finished coating or a final product. Next, the spacer layer 70 is applied to one surface of layer 35. Where the building structure is a wall, spacer 70 may be laid up alongside layer 35. Where the building structure is a roof or floor, spacer 70 may be laid on top of layer 35. Finally, an opposite or outside surface 78, formed of net and fixing agent, is applied over the intermediate spacer 70. Like wall 35, wall 78 is a tensile and compressive structural surface. Wall 78 can be the finished coating on the outside of wall 40.

The elements of a framework 30 may be supplemented by elements 72 as shown in FIG. 17. Either framework 30 or other elements 72 may be located between the shell sides 35, 78. Framework elements 30 would be permanent and non-removable from the section. In a method of forming the structure of FIG. 17, the framework elements 30 are erected to support a subsequently formed first shell side 35. The second shell side 78 is applied to the respective opposite face of the elements 30, providing the opposing, spaced shell of an exoskeleton and thereby defining the vessel for receiving material 70. The thickness of the layer 70 spaces the two walls of the exoskeleton. The thickness of layer 70 further defines strength and insulation of a wall, roof, or floor assembly.

Alternatively, posts or materials other than framework 30 can be utilized to position the second net or shell side 78. The frame elements 30 or alternative posts are attached to the first hardened shell side 35 to provide attachment and spacing for the opposite shell side 78 of the mold assembly. A net is attached to the second side of the posts or frame members 30 and hardened by application of a principal hardening layer as previously described. The resulting mold is filled with material 70, which is held in the mold until material 70 hardens, such as by hydration or polycondensation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The invention claimed is:

1. A method of forming a building Structure, comprising:

providing a first layer of flexible fabric comprising tensile load bearing fibers, the first layer of flexible fabric having load bearing capacity sufficient to serve as a mold when fixed;

deploying in situ the first layer of flexible fabric into a first preselected shape by:

draping the first layer of flexible fabric over a plurality of first supports located in a first position, allowing slack between the first supports; and placing second supports in the slack located between the first supports, thereby forming the first layer of flexible fabric into a folded plate configuration; and applying in situ a fixing material to the first layer of flexible fabric to fix the shape of the first flexible fabric, wherein applying the in situ fixing material to the first preselected shape results in a first self-supporting shell that is structurally adapted to hold the first preselected shape and to bear both applied tensile and applied compressive loading sufficient for the first self-supporting shell to be a structural member to serve as a mold or finished product.

2. The method of claim 1, further comprising applying a plurality of subsequent structural layers to the first layer of flexible fabric.

3. The method of claim 1, further comprising draping the first layer of flexible fabric over a plurality of first supports such that slack hangs between the first supports in a manner that forms catenaries.

4. The method of claim 1, wherein deploying in situ the first layer of flexible fabric into a first preselected desired shape comprises attaching the flexible fabric to one or more supports.

5. The method of claim 1, wherein the first layer of flexible fabric has a folded plate configuration.

6. The method of claim 1, wherein the building structure comprises a plurality of load bearing combined entities acting as a unified assembly, at least one combined entity of which comprises the first layer of fixed flexible fabric which provides a load capacity to bear an applied-tensile and compressive load, wherein each of the plurality of combined entities comprises at least one layer of fixed flexible fabric.

7. A method of forming an exoskeleton, comprising:

providing a first layer of flexible fabric comprising tensile load bearing fibers, the first layer of flexible fabric having a first tensile load bearing capacity to serve as a first structural component;

applying in situ a fixing material having a first compressive load bearing capacity to the first layer of flexible fabric to fix the shape of the first fabric into a first self-supporting shell adapted to bear both applied tensile and applied compressive loading sufficient for the first self-supporting shell to be a structural member for use a mold or finished assembly;

applying an intermediate layer of spacer material to the fixed first layer of fabric, wherein applying the intermediate layer comprises draping the first layer of flexible fabric over a plurality of first supports located in a first position, allowing slack between the first supports and placing second supports in the slack located between the first supports, thereby forming the first layer of flexible fabric into a folded plate configuration;

applying to the intermediate layer a second layer of flexible fabric comprising tensile load bearing fibers having a second tensile load bearing capacity to serve as a second structural component; and applying in situ a fixing material having a second compressive load bearing capacity to the second layer of flexible fabric to fix the shape of the second fabric.

8. The method of claim 7, wherein the first load bearing capacity is different from the second load bearing capacity.

9. The method of claim 7, wherein the intermediate layer further comprises insulation.

10. The method of claim 7, wherein the intermediate layer further comprises an expanded material.

11. The method of claim 7, wherein a thickness of the intermediate layer defines a depth of beam of the exoskeleton.

12. The method of claim 7, wherein the formed exoskeleton comprises a wall or roof of a building.

13. The method of claim 7, wherein the first and second layers of flexible fabric are different materials.

14. The method of claim 7, further comprising incorporating posts in the first and second layers of flexible fabric.

15. The method of claim 1, wherein the fixing material comprises a cementations material.

* * * * *